US008770804B2

(12) United States Patent
Acampora et al.

(10) Patent No.: US 8,770,804 B2
(45) Date of Patent: Jul. 8, 2014

(54) LIGHT FIXTURE HOUSING AND MOUNTING THEREFOR

(75) Inventors: Kenneth J. Acampora, Northridge, CA (US); Terry Bridges, Simi Valley, CA (US)

(73) Assignee: ABL IP Holding LLC, Conyers, GA (US)

( * ) Notice: Subject to any disclaimer, the term of this patent is extended or adjusted under 35 U.S.C. 154(b) by 451 days.

(21) Appl. No.: 13/224,646

(22) Filed: Sep. 2, 2011

(65) Prior Publication Data

US 2013/0058106 A1 Mar. 7, 2013

(51) Int. Cl.
*F21V 21/108* (2006.01)

(52) U.S. Cl.
USPC ..... 362/371; 362/370; 362/430

(58) Field of Classification Search
CPC ..... F21V 1/00; F21V 21/116; F21V 21/30; F21V 17/00; F21V 21/14; F21V 17/02; F21V 17/06; F21V 17/18; F21S 8/00; F21S 8/04; F21S 8/043; F16M 11/06; F16M 11/10; F16M 2200/02; F16M 2200/021; F16M 2200/022
USPC ..... 362/269, 285, 287, 368, 370, 371, 396, 362/417, 418, 427, 428, 430, 432; 248/291.1
See application file for complete search history.

(56) References Cited

U.S. PATENT DOCUMENTS 3,505,515 A * 4/1970 Adra ..... 362/371
3,543,016 A * 11/1970 Jones ..... 362/371
4,480,809 A * 11/1984 Healey ..... 248/185.1
6,161,948 A 12/2000 Hagen ..... 362/418
6,428,197 B1 * 8/2002 Downing ..... 362/523
2010/0254147 A1 * 10/2010 Tsao ..... 362/371

OTHER PUBLICATIONS

Large scale floodlights, BEGA-US Sep. 2009.
DFS2 Series DecoFlood Small Round—39-100 W HID—Philips WideLite, 2011 Bulletin No. WLSP0329A0211, pp. 1-8., Sep. 2, 2010.
DFS3 Series DecoFlood Medium Round—39-210 W HID—Philips WideLite, 2011—Bulletin No. WLSP0330A0211, pp. 1-12. Sep. 2, 2010.
Kim Lighting AXF20 Axial Flood™—Integral Ballast—rev. Oct. 1, 2008—5646008275, pp. 1-10.
Kim Lighting AXF30 Axial Flood™—Integral Ballast—rev. Oct. 1, 2008—5646108275, pp. 1-9.
DPN Series Part Night, Electronic Locking Type Photocontrol, Sheet # DTL-DPN-D, Sep. 2, 2010.
Gore, Protective Vents, Screw-in Vents brochure, PTV-031-R7-SCH-US-AUG11 (4 pgs.), Sep. 2, 2010.

* cited by examiner

*Primary Examiner* — Thomas Sember
(74) *Attorney, Agent, or Firm* — Kilpatrick Townsend & Stockton, LLP

(57) ABSTRACT

An architectural light fixture with a mounting includes a rigid yoke with opposed mounts aligned with external cavities located on a housing. The cavities have conical inner surfaces and bottoms with fastener engagements. Yoke pins include conical outer surfaces to operate as yoke locks. Fastener associated with the yoke pins engage to draw the yoke locks into interfering fit with the truncated conical inner surface of the mounting cavity. The light fixture housing has a port with a plug of porous water repellant material. A cover is employed to protect the plug. The light fixture housing also has a flat mounting surface with a wire access hole. The fixture includes a cover to enclose a photocell biased toward the mounting surface and retains an O-ring against the fixture housing.

8 Claims, 2 Drawing Sheets

LIGHT FIXTURE HOUSING AND MOUNTING THEREFOR

BACKGROUND OF THE INVENTION

The field of the present invention is architectural fixtures and mountings for lighting.

Typical yoke mounted fixtures utilize external opposed parallel surfaces on a fixture housing. These surfaces are either smooth or include radial serrations. The yoke associated therewith has matching inner surfaces alignable with the fixture housing surfaces. Concentrically arranged fasteners compress the surfaces together to create a friction joint that will prevent the yoke from slipping and losing the fixture aim. Smooth surfaces can be unreliable and allow slippage. This can be of concern, particularly for architectural lighting fixtures which may be difficult to access once in place. With serrated surfaces, slipping is unlikely. However, adjustability is limited by the pitch of the serrations.

Concentrically arranged fasteners acting as trunnions are also problematic with larger fixtures. If studs are employed in the housing, the yoke must be bent for assembly or disassembly. Bolts through the yoke can make assembly difficult and provide inadequate pivot members.

Architectural light fixtures have experienced additional issues. The housings typically have cavities which heat and cool with cycling of the light. Air pressure can vary significantly within the housings under such cycling. This can ultimately result in seal damage, leakage and lens distortion or failure.

An additional issue with exterior light housings is the employment of photocells to control the light. For lower wattage fixtures with large housings, internal temperatures do not greatly vary. In such fixtures, button-type photocells are typically employed. These photocells have temperature limitations and are impractical for higher wattage lights. For fixtures where the temperature will vary substantially, external photocell devices are typically employed. These photocells know as "twist lock" type photocells require that they remain in a vertical position to prevent water intrusion and subsequent failures. The external positioning of the cells also detracts from the architectural aesthetics.

SUMMARY OF THE INVENTION

The present invention is directed to architectural light fixtures employing light fixture housings.

A first separate aspect of the present invention is such a light fixture with a mounting. The mounting includes a rigid yoke having opposed mounts which are alignable with external opposed cavities located on the fixture housing. At least one of the cavities and one of the mounts cooperate to provide a locking feature. This feature includes a mounting cavity having a truncated conical inner surface and a bottom having a fastener engagement. A yoke pin extends through a bore in the mount of the rigid yoke. The pin includes a truncated conical outer surface to operate as a yoke lock. The yoke pin further includes a positioning surface to engage the yoke mount such that the conical outer surface of the yoke pin can be drawn into interfering fit with the truncated conical inner surface of the mounting cavity in the housing. The yoke pin operating as a lock includes a retainer to prevent rotation within the yoke mount. A fastener associated with the yoke pin can engage the fastener engagement to draw the yoke lock into interfering fit with the truncated conical inner surface of the mounting cavity.

The foregoing separate aspect of the present invention may further include a symmetrically positioned central mount having an inner truncated conical surface facing away from the yoke mounts through which a fastener extends to engage a supporting base.

A second separate aspect of the present invention includes a light fixture with a housing having a port there through with a plug of porous water repellant material known commercially as a gore vent. Such a plug allows the flow of air to and from the internal cavity of the fixture to maintain a neutral pressure. A cover with an exit to atmosphere is employed to protect the plug and shed water away from the plug regardless of the fixture orientation.

A third separate aspect of the present invention is a light fixture with a housing including a flat mounting surface with a wire access hole there through. A photocell is positioned on the mounting surface and the fixture includes a protective hard cover to enclose the photocell. The photocell is biased toward the mounting surface and includes a sealing surface facing the mounting surface to retain an O-ring between the photocell and the fixture housing about the wire access hole. The cover includes an aperture to enable operation of the photocell. The aperture is aligned with the light receptor of the photocell. The aperture may be open with the photocell being separately sealed.

In a further aspect of the present invention, any of the foregoing aspects are contemplated to the used in combination to better advantage.

Thus, it is an object of the present invention to provide an improved light fixture housing and mounting. Other and further objects and advantages will appear hereinafter.

DETAILED DESCRIPTION OF THE PREFERRED EMBODIMENTS

Figure 1:
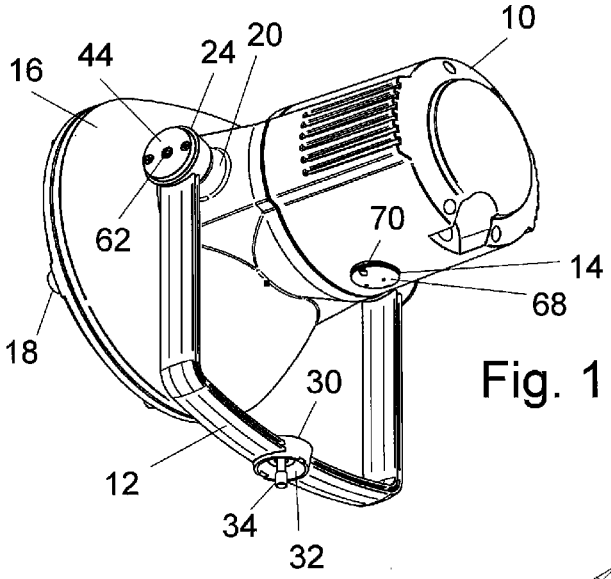
FIG. 1 is a perspective view of an assembled light fixture and mounting.

Turning in detail to the figures, a light fixture is illustrated in FIG. 1. The light fixture includes a housing 10 having a mounting 12 and a pressure management assembly 14. The light fixture housing 10 includes an internal cavity (not shown), a bell shaped reflector portion 16 and a lens assembly 18. Bosses 20 are located on the light fixture housing 10 in opposed positions. The mounting 12 aligns with these bosses 20.

Figure 2:
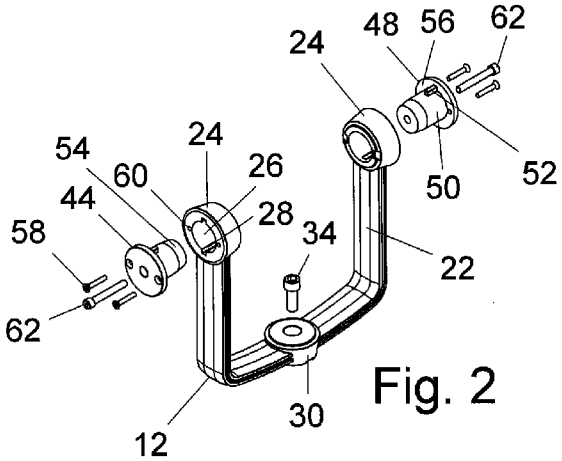
FIG. 2 is an exploded assembly perspective of the mounting of FIG. 1.
Figure 5:
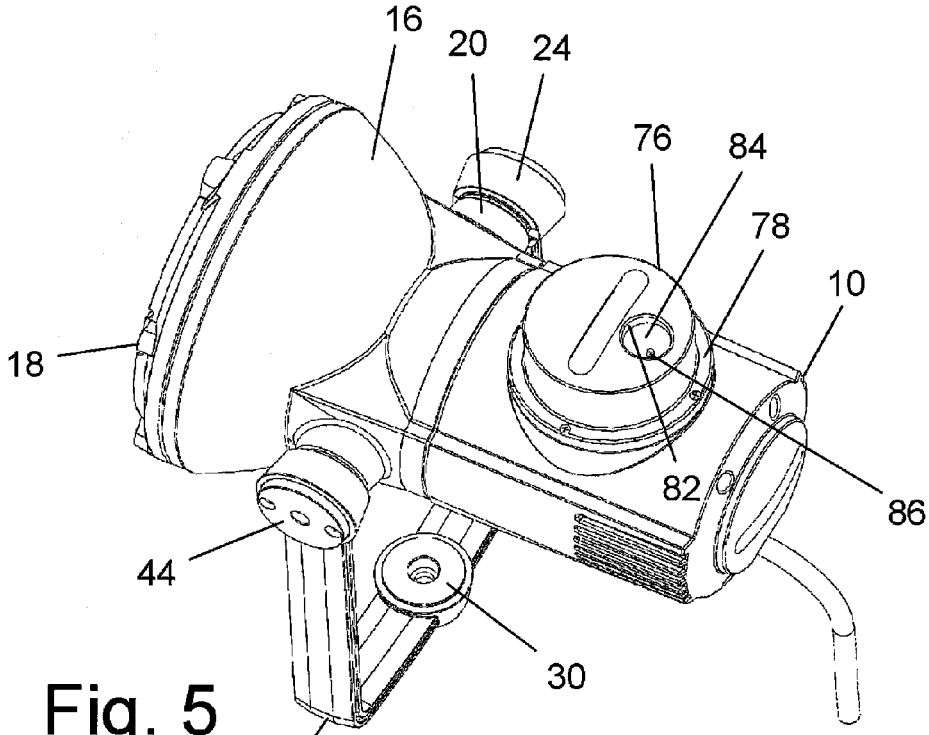
FIG. 5 is a perspective view of the fixture housing and mount of FIG. 1 showing a photocell mounting.
Figure 6:
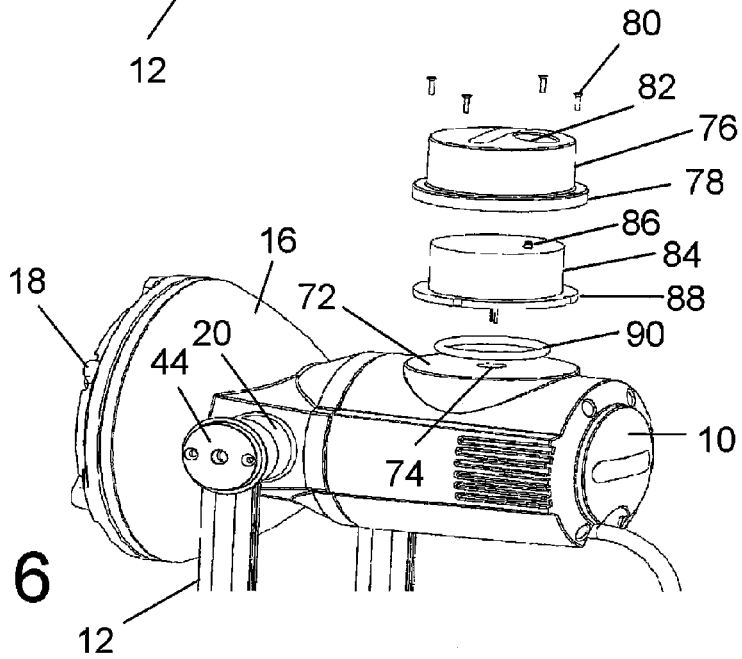
FIG. 6 is an exploded perspective view of the photocell associated with the fixture housing.

FIG. 2 is an exploded assembly view of the mounting 12. The mounting 12 includes a rigid yoke 22 having opposed mounts 24. The mounts 24 each have a cylindrical bore 26 there through with key ways 28 cut in the surface of each cylindrical bore 26. The cylindrical bores 26 are coaxial and align with the bosses 20 of the fixture housing 10 when positioned thereabout. The rigid yoke 22 further includes a central mount 30 which is symmetrically positioned. The central mount 30 has an inner truncated conical surface 32 facing away from the opposed mounts 24 with a fastener 34. The central mount 30 is for mounting with a truncated outer conical surface of a base support (not shown).

Figure 3:
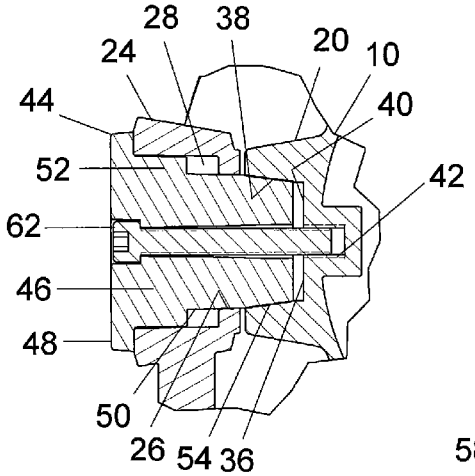
FIG. 3 is a cross-sectional detail taken through a center line of one mount assembled with the fixture housing of FIG. 1.
Figure 4:
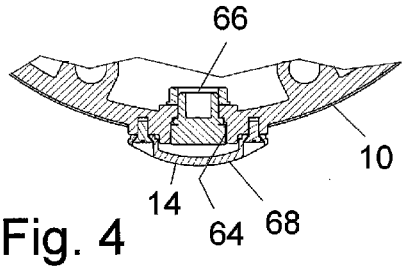
FIG. 4 is a cross-sectional front view in detail of a porous plug in the housing of FIG. 1.

Looking to FIG. 3, the bosses 20 are shown to have external and opposed mounting cavities 36, both sides being identical in the mountings. Each opposed mounting cavity 36 includes a truncated conical inner surface 38 with a bottom 40. A threaded hole 42 in the bottom 40 provides a fastener engagement.

Yoke pins 44 are positionable in the cylindrical bores 26 of the rigid yoke 22. One or both of these pins 44 operate as a yoke lock. The other may provide a simple trunnion pivot. In the preferred embodiment, the yoke pins 44 each are configured to be yoke locks. The yoke pins 44 extend through the cylindrical bores 26 to the opposed mounting cavities 36 of the light fixture housing 10.

Each yoke pin 44 includes a body 46 having a circular flange 48 at one end. The central portion 50 of the body 46 is cylindrical. This portion 50 fits closely within the cylindrical bore 26 of the opposed mount 24. The central portion 50 includes two keys 52 to mate with the key ways 28 within the cylindrical bore 26. Each yoke pin 44 further includes a truncated conical outer surface 54 on the end of the yoke pin 44 opposite to the circular flange 48. The truncated conical outer surface 54 has a conical angle to mate with the truncated conical inner surface 38. Through compression of these two surfaces 38, 54, longitudinal compression can produce an interference fit to lock the surfaces together. The circular flange 48 on the yoke pin 44 includes a positioning surface 56 to be brought against one side of the mount 24 for proper longitudinal placement of the pin 44. Fasteners 58 through the circular flange 48 extend to threaded holes 60 in the mount 24 to retain the yoke pin 44 in position within the mount 24. A threaded fastener 62 extends concentrically through the yoke pin 44 to engage the fastener engagement 42 in the bottom 40 of the mounting cavity 36.

In operation, the opposed mounts 24 of the rigid yoke 22 are positioned over the mounting cavities 36. The yoke pins 44 are extended through the cylindrical bores 26 to engage the mounting cavities 36. They are retained in appropriate position by the positioning surfaces 56 held in place by the threaded fasteners 58. The yoke pins 44 are then in engagement with the conical inner surfaces 38 of the opposed mounting cavities 36; and the fixture housing 10 can pivot thereabout to aim the fixture.

The concentrically arranged fasteners 62 are then engaged and tightened with the fastener engagements 42 to draw the inner and outer conical surfaces 38, 54 into locking engagement. The truncated conical outer surface 54 is of sufficient diameter at its truncated end so that it will not extend inwardly to the bottom 40 of the mounting cavity 36 before coming into interference fit with the inner surfaces 38. Further, the yoke pins 44 are retained relative to the opposed mounts 24 such that the fixture housing 10 and the mounts 24 of the rigid yoke 22 are spaced apart with the truncated conical inner surfaces 38 and the truncated conical outer surfaces 54 engaged in interference fit. These relationships ensure that tightening of the concentrically mounted fastener 62 will bring the inner and outer conical surfaces 38, 54 into interference fit.

The light fixture housing 10 further includes a port 64 on its underside. A plug 66 doses the port 64. This plug 66 is of porous water repellent material. Such plugs 66 are commercially available as gore vents. By being both porous and water repellent, the plug allows air but not moisture there through. As a result, the plug can relieve pressure within with central cavity of the light fixture housing 10 while preventing moisture intrusion as the fixture breathes. An external cover 68 is positioned over the port 64 and displaced from the plug 66. This external cover 68 has one or more holes 70 there through to provide an exit to atmosphere for air passing through the plug 66.

The light fixture housing 10 further includes on its upper surface an integral flat mounting surface 72. The mounting surface 72 includes a small hole 74 to provide wire access from within the central cavity of the light fixture housing 10. Threaded holes (not shown) are positioned about the mounting surface 72. A cover 76 including a cavity therein has a mounting flange 78 to mate with the mounting surface 72 and to be held in place by fasteners 80 engaging the threaded holes thereon. An open aperture 82 on the upper surface of the cover 76 provides light access into the interior of the cover 76.

A sealed photocell 84 is positioned within the cover 76 such that the light receptor 86 of the photocell 84 is aligned with the aperture 82. The photocell 84 has a flange 88 fitting under the mounting flange 78 of the cover 76. This assembly biases the photocell 84 downwardly toward the mounting surface 72 when the cover 76 is fastened to the light fixture housing 10. The bottom of the sealed photocell 84 has a sealed surface facing toward the mounting surface 72. An O-ring 90 positioned between the photocell 84 and the mounting surface 72 is compressed to seal the hole 74. An O-ring seat or seats may be included on one or both of the surfaces to position or retain the O-ring. With this assembly, a controlling photocell 84 is able to be employed with the housing 10 externally to the central cavity of the housing 10 with the light receptor 86 open to the environment; and yet, the assembly forms an integral part of the lamp assembly with appropriate environmental sealing for the main cavity of the housing 10.

Thus, an improved architectural light fixture and mounting is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A light fixture, comprising a fixture housing including two external and opposed mounting cavities, at least one of the cavities including a truncated conical inner surface and a bottom having a fastener engagement therein;

a rigid yoke including opposed mounts having bores there through alignable with the cavities;

yoke pins extendable through the bores to the opposed mounting cavities, at least one yoke pin including a yoke lock having a truncated conical outer surface, a positioning surface engageable with the mount to allow the truncated conical outer surface to engage in interfering fit with the truncated conical inner surface, a retainer preventing rotation between the yoke lock and the bore and a fastener engageable with the fastener engagement to draw the yoke lock into interfering fit with the truncated conical inner surface.

2. The light fixture of claim 1, the retainers being keys and keyways in engagement between the mounts and the yoke pins.

3. The light fixture of claim 1, the retainers being fasteners between the mounts and the yoke pins.

4. The light fixture of claim 1, the rigid yoke further including a symmetrically positioned central mount having an inner truncated conical surface facing away from the yoke mounts and a fastener extending there through.

5. The light fixture of claim 1, the at least one yoke lock being constructed and arranged to have the fixture housing and the mount of the rigid yoke spaced apart with the positioning surface engaged with the mount of the rigid yoke and the truncated conical outer surface engaged in interfering fit with the truncated conical inner surface.

6. The light fixture of claim 1, the fixture housing further including a port there through, a plug closing the port, the plug being of porous water repellant material, and an external water shedding cover over the port and plug with exit to atmosphere.

7. The light fixture of claim 1, the fixture housing further including an integral flat mounting surface with a wire access hole there through into the fixture housing, a cover fastened to the mounting surface with an aperture, a photocell having a sealed surface, the photocell being in the cover with the sealed surface facing and biased toward the mounting surface, and an O-ring between the mounting surface and the sealed surface.

8. A light fixture, comprising a fixture housing including two external and opposed mounting cavities, the cavities each including a truncated conical inner surface and a bottom having a fastener engagement therein;

a rigid yoke including opposed mounts having bores there through;

yoke locks extending through the bores to the opposed mounting cavities, respectively, and including truncated conical outer surfaces, positioning surfaces engaged with the mounts to allow the truncated conical outer surfaces to engage in interfering fit with the truncated conical inner surfaces, retainers preventing rotation between the yoke locks and the cavities and fasteners engaged with the fastener engagements to draw the yoke locks into interfering fit with the truncated conical inner surfaces.

* * * * *